US007077584B2

(12) United States Patent
Yoshida

(10) Patent No.: US 7,077,584 B2
(45) Date of Patent: Jul. 18, 2006

(54) DRYER FOR A RECORDING MEDIUM

(75) Inventor: Futoshi Yoshida, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 58 days.

(21) Appl. No.: 11/003,729

(22) Filed: Dec. 6, 2004

(65) Prior Publication Data

US 2005/0129398 A1 Jun. 16, 2005

(30) Foreign Application Priority Data

Dec. 15, 2003 (JP) ..... 2003-416907

(51) Int. Cl.
*G03D 13/00* (2006.01)
*G03D 3/08* (2006.01)

(52) U.S. Cl. ..... 396/571; 396/617; 396/620; 34/443; 355/27

(58) Field of Classification Search ..... None
See application file for complete search history.

(56) References Cited

U.S. PATENT DOCUMENTS 6,813,846 B1 * 11/2004 Yoshida ..... 34/443

FOREIGN PATENT DOCUMENTS

JP 64055563 * 3/1989
JP 8-76346 A 3/1996

* cited by examiner

*Primary Examiner*—D. Rutledge
(74) *Attorney, Agent, or Firm*—Sughrue Mion, PLLC

(57) ABSTRACT

Dry air is jetted from jet holes of a guide plate toward a conveyor belt to levitate a photosensitive sheet and to press it against the conveyor belt. The photosensitive sheet is supported and carried by the conveyor belt. The dry air dries the photosensitive sheet. A projection amount h of a guide roller projecting from the guide plate is defined so as to satisfy an expression of $h \geqq H \times (W-P)/W$. H is a gap between the guide plate and the conveyor belt. P is a length from a center line of the carried photosensitive sheet to an outer edge of the guide roller. W is a length from the center line to a lateral end of the photosensitive sheet. Even if a curl occurs on the photosensitive sheet, an edge thereof is prevented from contacting with the guide plate.

9 Claims, 4 Drawing Sheets

DRYER FOR A RECORDING MEDIUM

BACKGROUND OF THE INVENTION

1. Field of the Invention

The present invention relates to a dryer for a recording medium, and in particular to a dryer for drying a recording medium of a wet photosensitive material and so forth.

2. Description of the Related Art

In an automatic processor of a printer processor and so forth used in a photographic laboratory or the like, a photosensitive material of a photographic paper and so forth is cut by a cuter in accordance with a print size, and print processing is executed for the cut-sheet-shaped photosensitive material (hereinafter, called as a photosensitive sheet). After the print processing, the photosensitive sheets are sorted into a single row or into plural rows by a sorter, and then, are carried to a developing equipment. In general, the developing equipment is provided with carry rollers for carrying the photosensitive sheet, and processing baths containing processing solutions for color development, bleaching/fixing, washing, stabilization and so forth. The photosensitive sheet is carried to the respective processing baths by the carry rollers. While the photosensitive sheet passes through the respective processing solutions in order, development processing is executed.

After the development processing, moisture exists on the photosensitive sheet so that the photosensitive sheet is in a wet state. Thus, the moisture of the photosensitive sheet is removed at a squeegee portion. After that, the photosensitive sheet is carried to a drying portion to perform a dry processing. The drying portion is provided with a carry rack for carrying the photosensitive sheet, a blower, a heater and so forth. The blower jets the air (hereinafter, called as dry air) heated by the heater and having adjusted humidity to dry the photosensitive sheet.

The drying portion comprises an endless mesh belt and a guide plate. The guide plate is disposed under the mesh belt and is formed with many jet holes for the dry air. A passage for carrying the photosensitive sheet is defined between the guide plate and the mesh belt. The photosensitive sheet is carried in a state that a photosensitive emulsion surface confronts the guide plate to prevent the emulsion surface from being damaged. By jetting the dry air from the guide plate, an opposite surface (hereinafter, called as a rear surface) to the photosensitive emulsion surface is pressed against the mesh belt and is supported thereby. The photosensitive sheet is carried in association with movement of the mesh belt. In virtue of this, the photosensitive emulsion surface is kept in a noncontact manner so that defects of abrasions, dirt and so forth are prevented from occurring thereon (see Japanese Patent Laid-Open Publication No. 8-76346, for example).

By the way, the photosensitive emulsion surface of the photosensitive sheet shrinks at the time of drying so that curling is caused to convexly curve the rear surface. This curl curves in a direction perpendicular to a carry direction so as to be a gutter-shaped curl. If a degree of curling becomes large, both edges of the photosensitive sheet are likely to come into contact with the guide plate, and the defects of abrasions, dirt and so forth are likely to be caused on the emulsion surface. Further, if a corner of the photosensitive sheet is caught by a nozzle, it becomes impossible to perform aligned carry, since a carry position is disarrayed. In addition, jamming is sometimes caused. In consideration of this, the guide plate is provided with a skewer roller to prevent the photosensitive sheet from coming into contact with the guide plate, such as described in the above-noted Publication No. 8-76346. By doing so, the abrasions and the jamming are adapted to be prevented from occurring. However, in the Publication No. 8-76346, since a lot of the skewer rollers are arranged, a number of the jet holes is limited. Thus, there arises a problem in that the blower is enlarged for the purpose of keeping necessary levitation force of the photosensitive sheet.

SUMMARY OF THE INVENTION

In view of the foregoing, it is a primary object of the present invention to provide a dryer for a recording medium in which an arrangement number of guide rollers is as fully reduced as possible to effectively perform a levitation carry of the recording medium.

It is a second object of the present invention to provide a dryer for a recording medium in which abrasions and dirt are prevented from occurring on a photosensitive emulsion surface.

In order to achieve the above and other objects, the dryer for the recording medium according to the present invention comprises a guide plate, a conveyor and guide rollers. In the dryer, the wet recording medium is dried by jetting dry air while carried in a passage. The guide plate is disposed along the passage and at a position confronting the recording medium. The guide plate has jet holes for jetting the dry air toward the recording medium. The conveyor carries the recording medium along the passage. The recording medium is separated from the guide plate by the dry air jetted from the jet holes. The guide roller partially projects into the passage through the guide plate. In the dryer, the following conditional expressions are satisfied.

$$h \geqq H \times (W-P)/W,\ H>h \text{ and } W>P$$

In this expression, H(mm) is a gap between the guide plate and the conveyor, P(mm) is a length from a center line of the carried recording material to an outer edge of the guide roller, W is a half length of the recording medium in a direction perpendicular to a carry direction of the recording medium, and h(mm) is a height of the guide roller projecting from the guide plate.

In a preferred embodiment, the conveyor is an endless belt laid between two rollers. The endless belt is formed with exhaust openings through which the dry air passes. The dry air having passed through the endless belt circulates and is jetted from the jet holes of the guide plate again. It is preferable that the dryer further comprises a blower and a heater. The blower circulates the dry air. The heater heats the dry air up to a predetermined temperature.

According to the dryer of the present invention, both edges of the recording medium are prevented from coming into contact with a surface of the guide plate so that defective carry is prevented.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
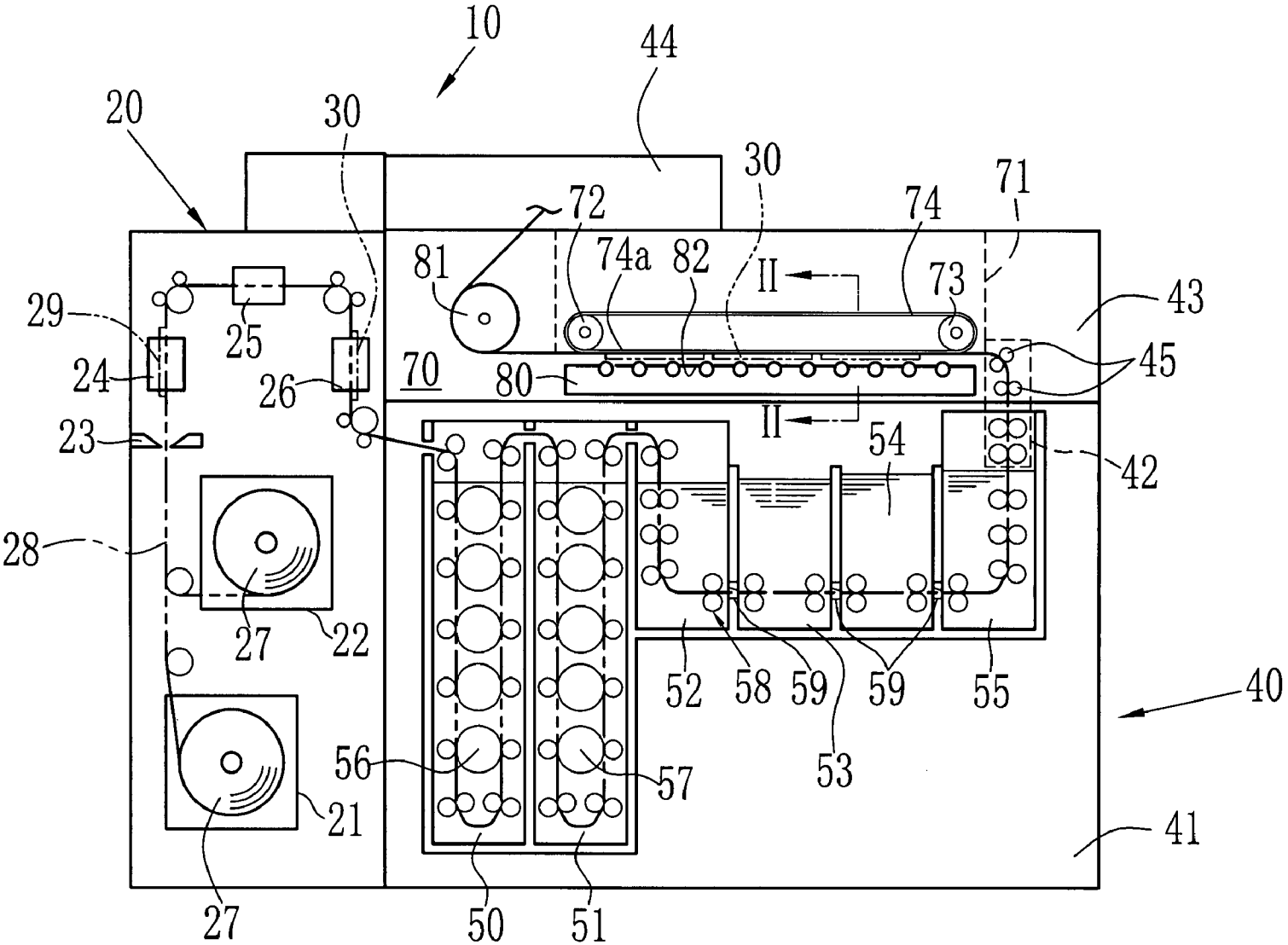
FIG. 1 is a schematic illustration showing a printer processor comprising a dryer according to the present invention.

FIG. 1 schematically shows an inner structure of a printer processor 10 comprising a dryer according to the present invention. The printer processor 10 comprises a printer section 20 and a processor section 40. The printer section 20 includes magazines 21 and 22, a cutter 23, a back-printing unit 24, an exposure unit 25 and a sorter 26. A photosensitive material 27 having a strip shape is wound and set in each of the magazines 21 and 22. The photosensitive material 27 is carried toward the exposure unit 25 along a passage 28 shown by a chain double-dashed line. The cutter 23 cuts the photosensitive material 27 into a photosensitive sheet 29 in accordance with a print size. The back-printing unit 24 prints a frame number, correction data and so forth on a rear surface. The exposed photosensitive sheets 30 are sorted by the sorter 26 into a single row or into plural rows in accordance with the print size. And then, the exposed photosensitive sheet 30 is carried to the processor section 40.

The processor section 40 includes a processing portion 41, a squeegee portion 42, a drying portion 43 and a sorting portion 44. The processing portion 41 includes a developing bath 50, a bleaching/fixing bath 51 and first to fourth washing baths 52 to 55, which are disposed in order from an upstream side of the passage 28 of the material to be dried. The developing bath 50, the bleaching/fixing bath 51 and the first to fourth washing baths 52 to 55 respectively contain a developing solution, a bleaching/fixing solution and a washing solution by a predetermined amount. The developing bath 50 and the bleaching/fixing bath 51 are provided with carry racks 56 and 57 comprising carry rollers for carrying the photosensitive sheet 30 in the respective baths along a substantially U-shaped route. The first to fourth baths 52 to 55 contain many carry roller pairs 58 for carrying the photosensitive sheet 30. The carry racks 56, 57 and the carry roller pairs 58 carry the photosensitive sheet 30 in the respective baths 50 to 55 to perform processing.

As to the washing baths 52 to 55, the photosensitive sheet 30 is forwarded to the next bath through a submerged squeegee member 59 disposed at a partition wall. The submerged squeegee member 59 comprises an elastic thin blade, which allows the photosensitive sheet 30 to pass through and prevents the washing solution from flowing out. Meanwhile, a squeegee roller pair 45 of the squeegee portion 42 nips and carries the photosensitive sheet 30, which has been sent from the processing portion 41, to forward it to a conveyor belt 74. Incidentally, instead of using the submerged squeegee member 59, a carry system using a carry rack may be adopted similarly to the other baths 50 and 51.

The drying portion 43 includes a drying chamber 70 and a carry rack 71. This carry rack 71 comprises the conveyor belt 74, which is formed from a mesh endless belt and is laid between belt rollers 72 and 73. The drying chamber 70 comprises a blower duct 80 confronting a conveying surface 74*a* of the conveyor belt 74. The photosensitive sheet 30 is dried in the drying chamber 70 and is forwarded to the sorting portion 44 by a conveyor roller 81. The sorting portion 44 sorts the photosensitive sheets in accordance with an ordered size. Incidentally, a method for drying the photosensitive sheet 30 in the drying chamber 70 is described later in detail.

Figure 2:
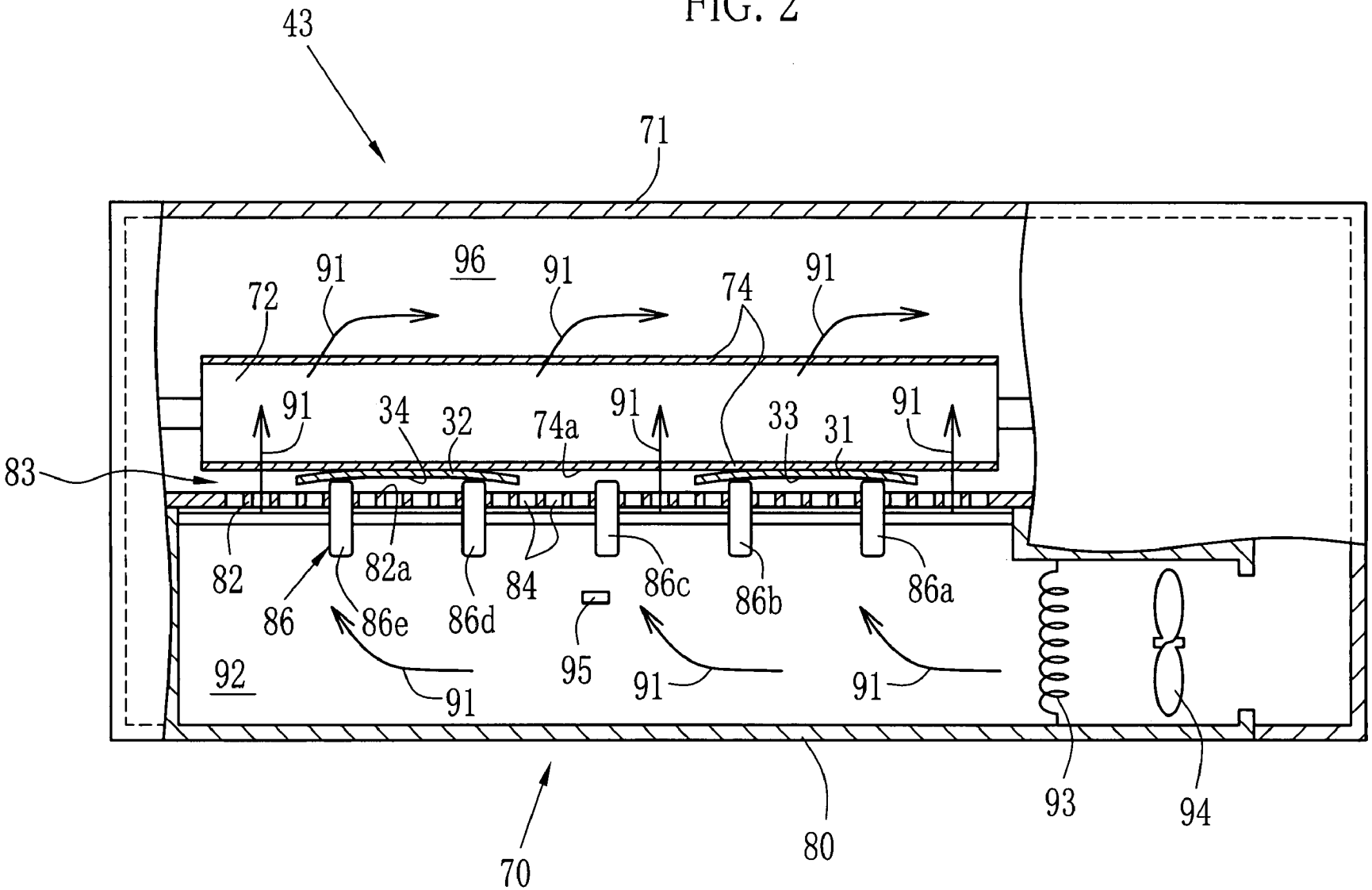
FIG. 2 is a section view taken along a II—II line of FIG. 1.
Figure 3:
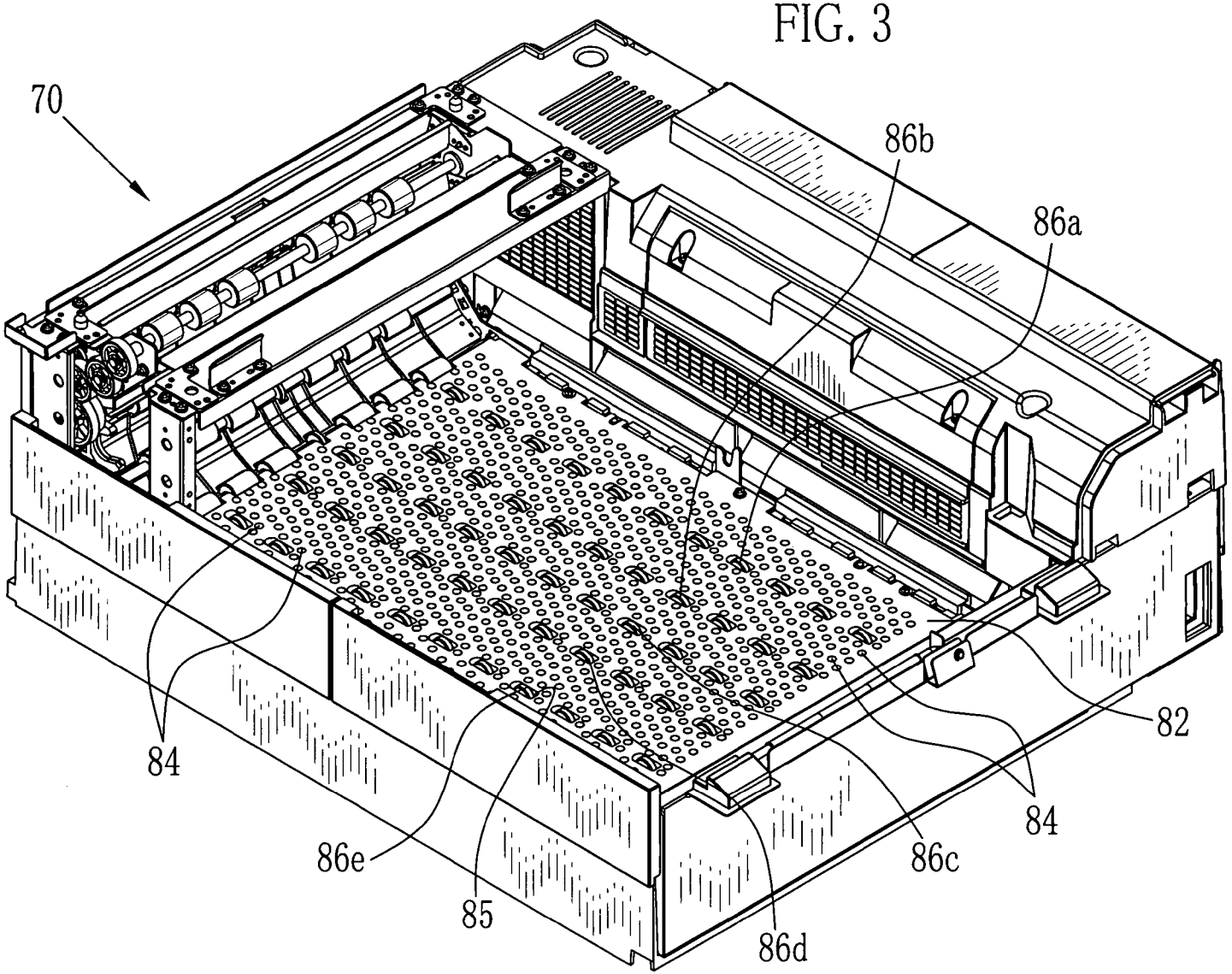
FIG. 3 is a perspective view showing a drying chamber.

FIG. 2 shows a sectional view taken along II—II line of the drying portion 43. FIG. 3 shows a perspective view of the drying chamber 70. The blower duct 80 is disposed along the conveyor belt 74, and a region thereof confronting the conveying surface 74*a* is provided with a guide plate 82. A gap between the conveying surface 74*a* and a surface 82*a* of the guide plate 82 defines a passage 83 for carrying the photosensitive sheets 31 and 32.

The guide plate 82 is made of aluminum, and the surface 82*a* thereof confronting the photosensitive sheet is painted in black. Thus, the guide plate 82 has high thermal conductivity and has high thermal emissivity relative to the photosensitive sheet (total reflection is 0.9 or more). Consequently, radiation heat quantity increases so that it is possible to effectively dry the photosensitive sheet. The guide plate 82 is provided with a large number of circular jet holes 84 (see FIG. 3). The shape of the jet hole 84 is not limited to the circle but may be an ellipse shape, a slit and so forth. The guide plate 82 is also provided with many openings 85 through which guide rollers 86*a*, 86*b*, 86*c*, 86*d* and 86*e* of a skewer roller 86 partially protrude to a side of the passage 83. The skewer rollers 86 are arranged parallel with each other in a direction perpendicular to a carry direction of the photosensitive sheet.

In order to jet the dry air 91 from the jet holes 84, a pathway 92 for supplying the dry air is formed in the blower duct 80, such as shown in FIG. 2. The inside of the pathway 92 is provided with a heater 93 and a blower 94. The blower 94 is formed from a cross flow fan to circulate the dry air 91 in the drying portion 43. The heater 93 heats the dry air 91 up to about 60° C. to 90° C. Meanwhile, a temperature sensor 95 is attached to the inside of the blower duct 80, and a temperature detected by this sensor 95 is sent to a controller, which is not shown. The controller performs feedback control of the heater 93 on the basis of the temperature detected by the temperature sensor 95 to keep the dry air 91 at a constant temperature. The dry air 91 passes through the conveyor belt 74 and goes in a dry-air discharge passage 96. The dry air 91 is used again after predetermined adjustment.

The photosensitive sheets 31 and 32 are carried in a state that they are pressed against the conveyor belt 74 by the dry air 91 discharged from the jet hole 84 of the guide plate 82. Thus, photosensitive emulsion surfaces 33 and 34 of the photosensitive sheets 31 and 32 are carried in a state that they are separated from the guide plate 82. Consequently, the photosensitive emulsion surfaces 33 and 34 are prevented from being damaged due to a rub caused between the photosensitive sheets 31, 32 and the guide plate 82.

Figure 4:
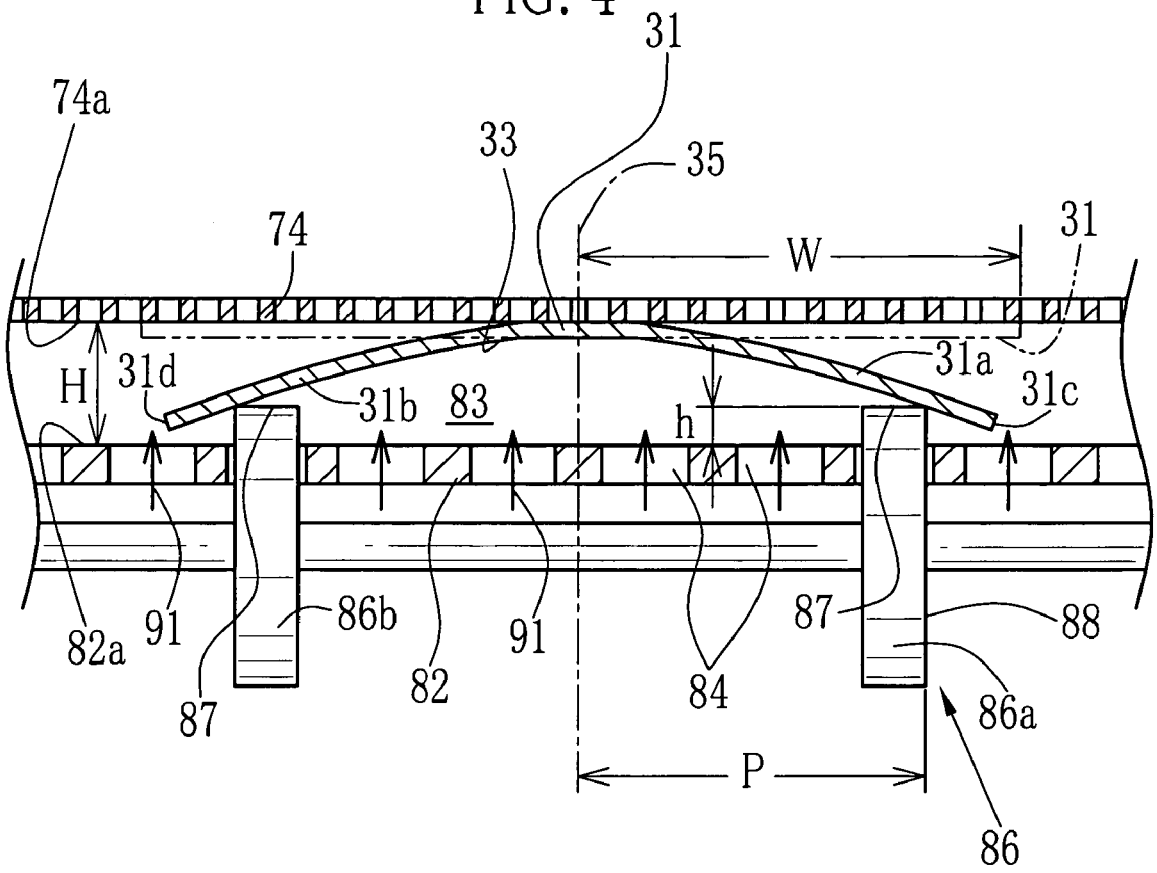
FIG. 4 is a partial section view showing a passage of the dryer shown in FIG. 1.

Such as shown in FIG. 4, gutter-shaped curls 31*a* and 31*b* occur on the photosensitive sheet 31, which is carried in a state that a rear surface thereof faces upward and forms a convex shape. When the dry air 91 is jetted to press the photosensitive sheet 31 against the conveyor belt 74, both edges 31*c* and 31*d* are likely to come into contact with the surface 82*a* of the guide plate 82. In the present invention, the edges 31*c* and 31*d* are prevented from coming into contact with the surface 82*a* of the guide plate 82 by regulating peripheries 87 of the guide rollers 86*a* and 86*b* of the skewer roller 86. The periphery 87 is regulated such that a height thereof projecting from the surface 82*a* is regulated within a predetermined range.

Figure 5:
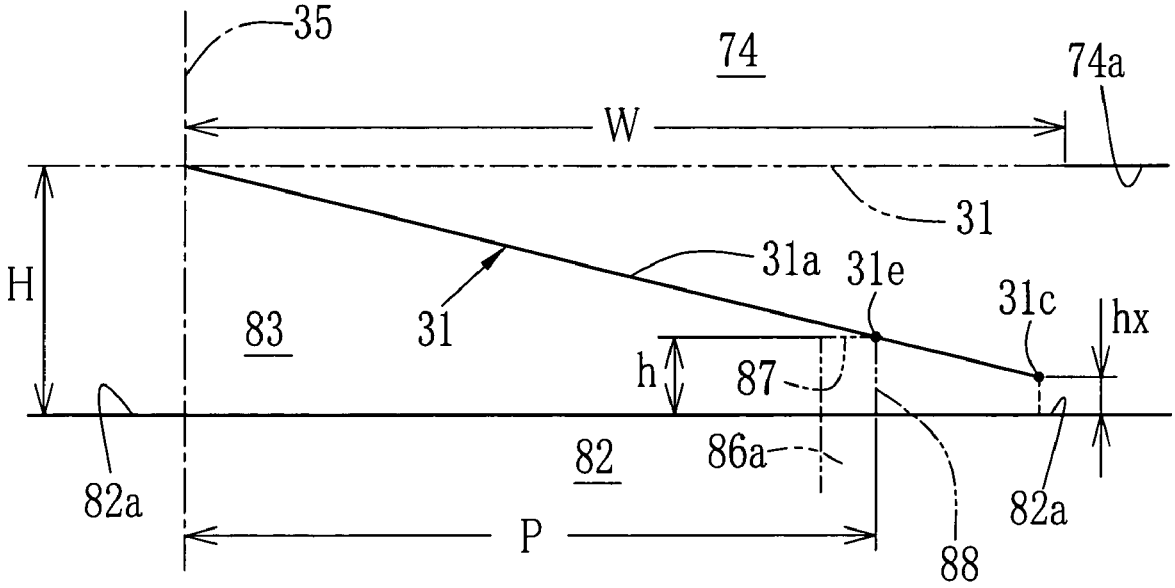
FIG. 5 is an illustration for explaining a state taken in the passage of the dryer.

FIG. 5 schematically shows a positional relationship of the conveyor belt 74, the passage 83, the photosensitive sheet 31 and the guide plate 82. A carry position of the photosensitive sheet 31 having no curl is shown by a chain double-dashed line in FIGS. 4 and 5. The height of the periphery 87 of the guide roller 86*a* projecting from the surface 82*a* of the guide plate 82 is denoted by h(mm). The gap between the conveying surface 74*a* of the conveyor belt 74 and a surface 82*a* of the guide plate 82 is denoted by H(mm). A first length from a center line 35 of the carried photosensitive sheet 31 to one end of the photosensitive sheet 31 is denoted by W(mm). A second length from the center line 35 to an outer side 88 of the guide roller 86*a* is denoted by P(mm).

The curl 31*a* of the photosensitive sheet 31 is expediently represented as a straight line in FIG. 5. A thickness of the photosensitive sheet 31 is left out of consideration, since this thickness is fully thin in comparison with the gap H of the passage. In this case, the edge 31*c* of the photosensitive sheet 31 is prevented from coming into contact with the surface 82*a* of the guide plate 82 when the following condition is satisfied.

$$hx=\{H-(H-h)\times W/P\}\geqq 0 \quad (1)$$

This mathematical expression (1) is expressed as follows.

$$H\geqq W(H-h)/P \quad (2)$$

This mathematical expression (2) is expressed as follows relative to h.

$$h\geqq H\times(W-P)/W \quad (3)$$

The projection amount h(mm) of the guide roller 86*a* is adjusted so as to satisfy the mathematical expression (3). Further, the guide roller is disposed so as to satisfy the relationship of W>P. Reference numeral 31*e* denotes a position where the photosensitive sheet 31 comes into contact with the outer side 88 of the guide roller 86*a*. The photosensitive sheet 31 is lifted by the periphery 87 at the contact position 31*e*. In virtue of this, the height hx(mm) from the surface 82*a* to the edge 31*c* of the photosensitive sheet 31 surely becomes zero or more. Incidentally, the other curl 31*b* of the photosensitive sheet 31 has a similar state so that contacting with the surface 82*a* of the guide plate 82 is prevented. Since the curls 31*a* and 31*b* come into contact with the peripheries 87 of the guide rollers 86*a* and 86*b* so as to be lifted, the edges 31*c* and 31*d* are carried without coming into contact with the surface 82*a* of the guide plate 82. When the guide rollers 86*a* and 86*b* satisfy the above expression (3), only two guide rollers 86*a* and 86*b* are sufficient relative to the photosensitive sheets 31 of a single size. Thus, a number of the guide rollers may be reduced. In the above embodiment, the two-row carry is performed when the print size is small. For this, the guide rollers 86*a*, 86*b*, 86*d* and 86*e* are provided for the respective rows.

In a case of the plural-row carry and also in a case of the photosensitive sheets having different sizes, the number of the guide rollers may be minimized by defining the edge position and the height of the guide roller on the basis of the above expression (3) and the center line of the carried photosensitive sheet. As the number of the guide rollers is reduced, levitation efficiency is improved.

FIG. 2 shows the embodiment in that the two photosensitive sheets 31 and 32 are carried and dried. In the present invention, however, it is possible to carry and dry the photosensitive sheet having a wide width. Moreover, it is also possible to carry and dry the three or more photosensitive sheets by projecting the guide rollers, a number of which corresponds to the photosensitive sheets to be simultaneously carried, in the direction perpendicular to the carry direction of the passage 28. Incidentally, when the plural photosensitive sheets are carried, they may be carried in parallel and in a zigzag state.

The dryer for the recording medium according to the present invention is applicable also when a recording paper or the like is dried in an ink-jet printer.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A dryer for a recording medium in which the wet recording medium is dried by jetting dry air while carried in a passage, said dryer comprising:

a guide plate disposed along said passage and at a position confronting said recording medium, said guide plate having jet holes for jetting said dry air to said recording medium;

a conveyor for carrying said recording medium along said passage, said recording medium being separated from said guide plate by said dry air jetted from said jet holes, and said conveyor being disposed so as to confront said guide plate to form said passage; and a plurality of guide rollers partially projecting into said passage from said guide plate, wherein the following conditional expressions are satisfied, $$h\geqq H\times(W-P)/W,\ H>h \text{ and } W>P$$

in which H(mm) is a gap between said guide plate and said conveyor,

P(mm) is a length from a center line of the carried recording material to an outer edge of said guide roller, W(mm) is a half length of said recording medium in a direction perpendicular to a carry direction of said recording medium, and h(mm) is a height of said guide roller projecting from said guide plate.

2. A dryer according to claim 1, wherein said conveyor is disposed above said guide plate so as to face each other, and a portion of said recording medium levitated by the dry air is pressed against the conveyor.

3. A dryer according to claim 2, wherein said conveyor is an endless belt laid between two rollers.

4. A dryer according to claim 3, wherein said endless belt is formed with exhaust openings through which said dry air passes.

5. A dryer according to claim 4, wherein said dry air having passed through said endless belt circulates and is jetted from said jet holes again.

6. A dryer according to claim 5, further comprising:

a blower for circulating said dry air; and a heater for heating said dry air up to a constant temperature.

7. A dryer according to claim 6, wherein said guide plate is made of aluminum and a surface thereof is painted in black.

8. A dryer according to claim 6, wherein said jet hole has a circular shape.

9. A dryer according to claim 4, wherein said recording medium is a photosensitive material having passed through a processing solution.

* * * * *